US006411188B1

(12) United States Patent
Pruess et al.

(10) Patent No.: US 6,411,188 B1
(45) **Date of Patent: *Jun. 25, 2002**

(54) AMORPHOUS METAL TRANSFORMER HAVING A GENERALLY RECTANGULAR COIL

(75) Inventors: D. Christian Pruess, Morristown; David M. Nathasingh, Hackettstown, both of NJ (US)

(73) Assignee: Honeywell International Inc., Morris Township, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/276,164

(22) Filed: Mar. 25, 1999

Related U.S. Application Data

(60) Provisional application No. 60/079,625, filed on Mar. 27, 1998.

(51) Int. Cl.[7] ..... H01F 27/02; H01F 27/30

(52) U.S. Cl. ..... 336/96; 336/205; 336/213; 336/219; 29/602.1

(58) Field of Search ..... 336/213, 96, 205, 336/219, 60; 29/602.1, 606

(56) References Cited

U.S. PATENT DOCUMENTS

| | | | | |
|---|---|---|---|---|
| 3,153,216 A | * | 10/1964 | Klitten | 336/223 |
| 3,212,172 A | | 10/1965 | Davis | 29/155.57 |
| 3,233,311 A | * | 2/1966 | Giegerich et al. | 336/96 |
| 3,434,087 A | * | 3/1969 | Hofmann | 336/96 |
| 3,548,355 A | * | 12/1970 | Martincic et al. | 336/96 |
| 3,611,226 A | * | 10/1971 | Cotton | 336/96 |
| 3,708,875 A | * | 1/1973 | Martincic et al. | 29/605 |
| 3,750,071 A | * | 7/1973 | Eley | 336/96 |
| 3,774,298 A | * | 11/1973 | Eley | 29/605 |
| 4,599,594 A | * | 7/1986 | Siman | 336/92 |
| 4,751,488 A | * | 6/1988 | Lanoue et al. | 336/84 R |
| 5,242,760 A | * | 9/1993 | Matsuoka et al. | 428/692 |
| 5,455,392 A | * | 10/1995 | Preu et al. | 174/120 R |
| 5,470,646 A | * | 11/1995 | Okamura et al. | 428/216 |
| 5,639,566 A | * | 6/1997 | Okamura et al. | 428/692 |

FOREIGN PATENT DOCUMENTS

| | | | |
|---|---|---|---|
| EP | 0 082 954 A1 | 7/1983 | H01F/31/00 |
| FR | 2 289 039 | 5/1976 | H01F/27/30 |
| GB | 1087594 | 10/1967 | H01F/27/32 |
| GB | 1156369 | 6/1969 | H01F/27/36 |

OTHER PUBLICATIONS

Patent Abstracts of Japan for JP 58–14515 A Aug. 22, 1983.
Copy of PCT Search Report for PCT/US99/06476 dated Jul. 9, 1999.
Copy of PTO–Form 892 from U.S. Ser. No. 09/276,032.

* cited by examiner

*Primary Examiner*—Anh Mai
(74) *Attorney, Agent, or Firm*—Roger H. Criss

(57) ABSTRACT

A dry-type power distribution transformer has a generally rectangular, wound amorphous metal core and a resin encapsulated, generally rectangular coil. The core has a generally rectangular core window within which is located a substantially straight section of the coil. When assembled to form a power distribution transformer, the shape of the coil's substantially strait section conforms to the shape of the core window. The transformer is inexpensive to manufacture, exhibits low resistivity and low core loss, and is light weight, compact and reliable in operation.

45 Claims, 8 Drawing Sheets

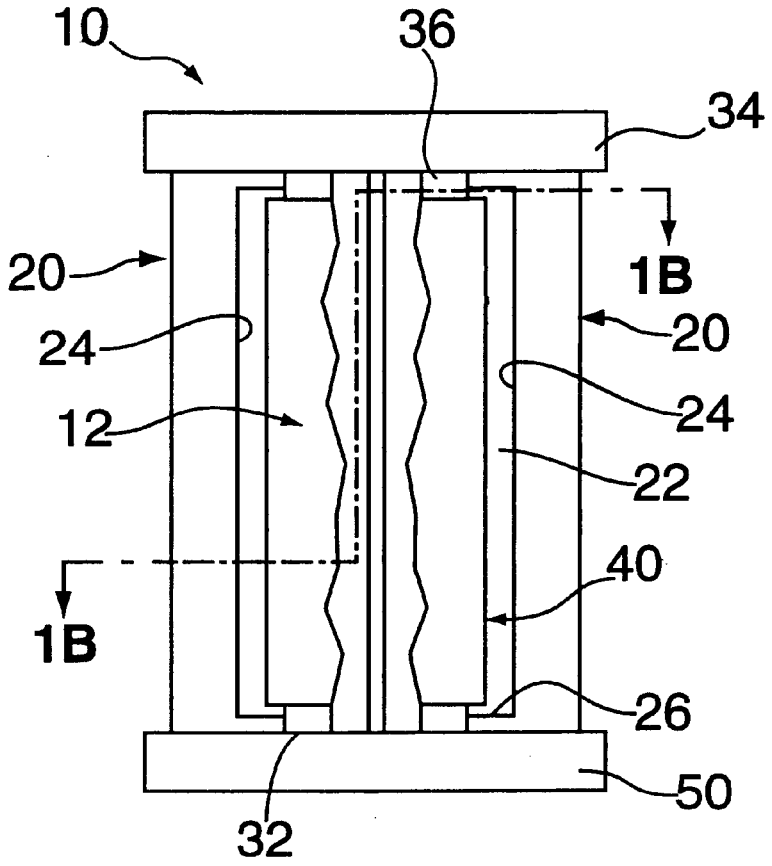
FIG. 1A
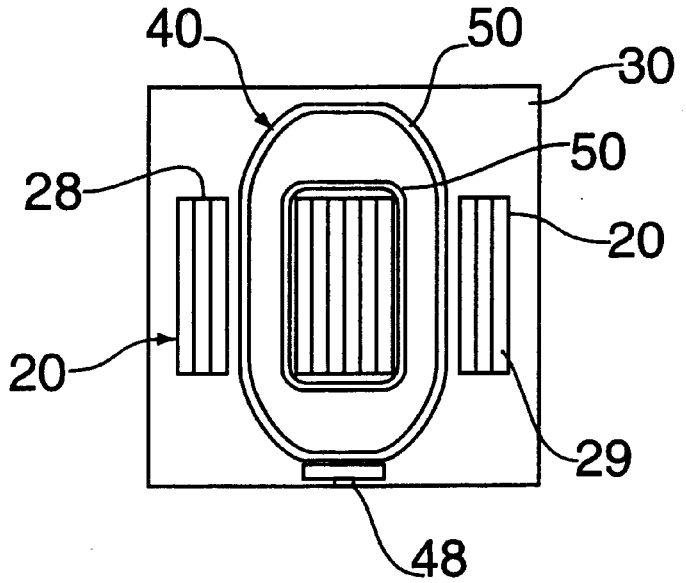

AMORPHOUS METAL TRANSFORMER HAVING A GENERALLY RECTANGULAR COIL

This application claims the benefit of U.S. Provisional Application No. 60/079,625, filed Mar. 27, 1998.

BACKGROUND OF THE INVENTION

1. Field of the Invention

The present invention relates to transformers; and more particularly, to a dry-type power distribution transformer having a wound amorphous metal core and a generally rectangular resin encapsulated coil.

2. Description of the Prior Art

Conventional dry-type power distribution transformers have a round or toroidal open wound coil and a silicon steel or amorphous metal core of the wound or stacked variety. The transformer core typically has a rectangular shape defining a rectangular window within which the coil is located. Frequently, the toroidal shape of the coil creates a mismatch between the core and coil insofar as the core window is concerned, i.e. the shape of the rectangular window does not match the shape of the section of the coil that is located therein. This mismatch between the core and coil causes the size and cost of the transformer to be significantly larger than would be required if the transformer had more closely matched core and coil shapes.

Wound cores used in power distribution transformers, whether silicon steel or amorphous metal, are rectangular in cross-section and do not conform to the round shape of the coil. Stacked silicon steel transformer cores, on the other hand, may have a cruciform cross-section that can approximately match the coil's toroidal shape. Due to the high expense of casting or cutting an amorphous metal strip to a variety of widths, it is impractical to form a stacked amorphous metal core with a cruciform cross-section. For these reasons, in manufacture of dry-type power distribution transformers having amorphous metal cores, whether wound or stacked, the cross-sectional shape of the core (i.e. rectangular) and the shape of the coil (i.e. round) do not match. Usage of coil material is uneconomical, and transformer sizes are too large.

Power distribution transformers may be installed in a variety of locations and subject to extreme environmental conditions such as, for example, particulate matter (dust, dirt, etc.), moisture, caustic substances, and the like, which adversely effect the life span and performance of the transformer. Open wound coils provide no protection against the effects of such the harsh environments.

SUMMARY OF THE INVENTION

The present invention provides a dry-type power distribution transformer having a wound amorphous metal core and a generally rectangular, resin encapsulated coil. The core has a generally rectangular cross-sectional shape that closely matches the generally rectangular shape of the resin encapsulated coil. By matching the shape of the coil to that of the core's cross-section, there is provided a dry-type amorphous metal power distribution transformer that is less expensive to manufacture, less resistive and less lossy, in that less coil material is needed to wind the coil, and more compact than transformers having generally round or circular coils.

Generally stated, the dry-type dry-power distribution transformer includes a resin encapsulated generally rectangular coil having a substantially straight section and an amorphous metal core having a generally rectangular core window defined therein. The coil and the core are sized and shaped such that the shape of the substantially straight section of the coil substantially conforms to the shape of the core window. When the coil and core are assembled to form a power distribution transformer, the substantially straight section of said coil is located within the core window. The resin encapsulation protects the coil against harsh environmental conditions, protects the insulation system of the coil, improves the coil strength under short-circuit conditions, and improves the coil's cooling characteristics by providing a smooth, uniform surface about the coil's exterior over which air (either forced or convective) may smoothly and easily pass.

Advantageously, the dry-type power distribution transformer of the invention is durable and robust. Coil and core materials are utilized in a highly economical manner that significantly decrease manufacturing cost and transformer size. These features are especially desirable in power distribution transformers where size, cost, and performance govern market acceptance.

BRIEF DESCRIPTION OF THE DRAWINGS

The invention will be more fully understood and further advantages will become apparent when reference is had to the following detailed description and the accompanying drawings, wherein like reference numerals denote similar elements throughout the several views and in which:

FIG. 1A is a frontal view of a shell-type single phase transformer constructed in accordance with the present invention with the coil partially cut-away;

DETAILED DESCRIPTION OF THE INVENTION

Figure 1B:
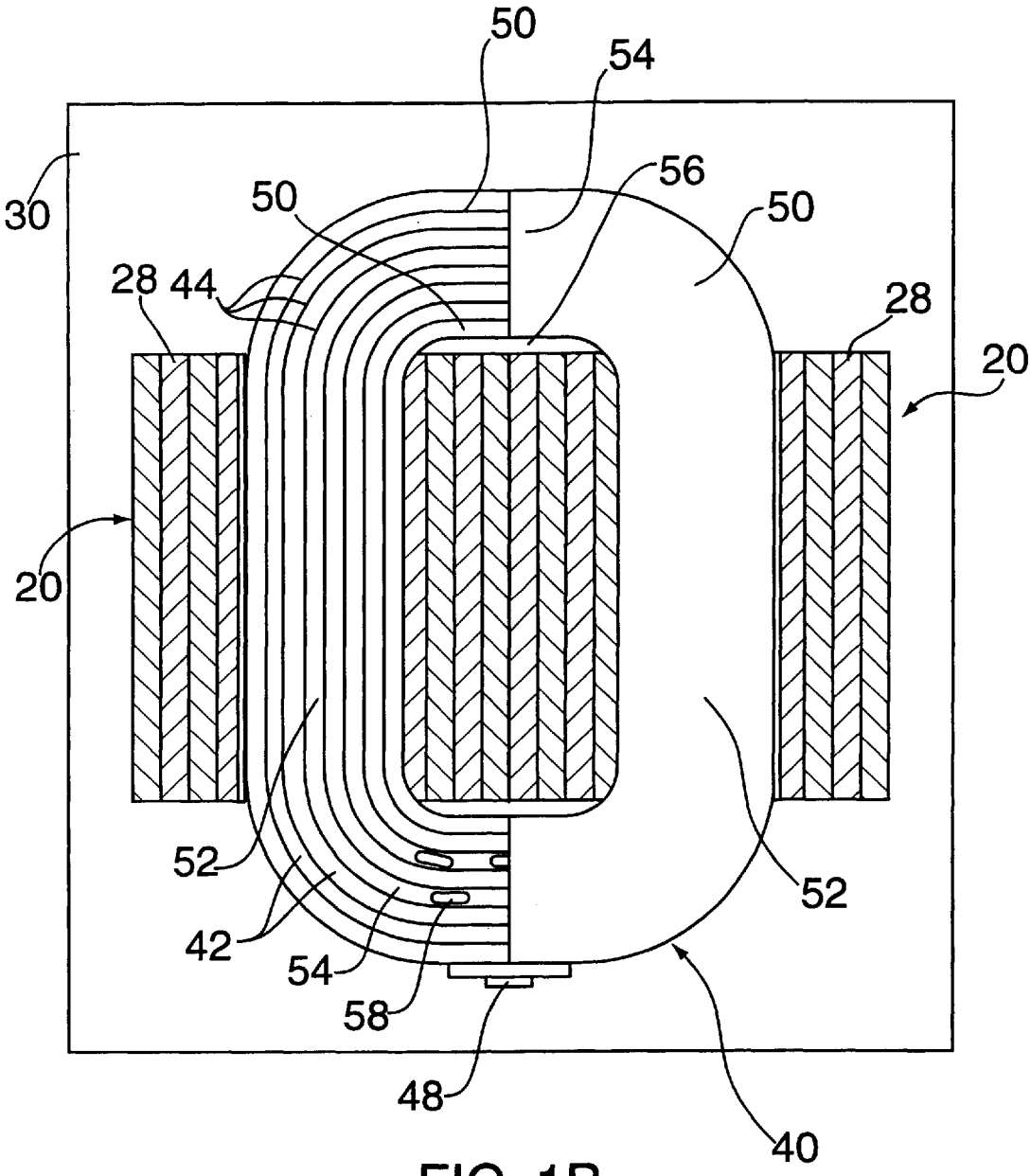
FIG. 1B is a cross-sectional view taken along line B—B of FIG. 1A.
Figure 2A:
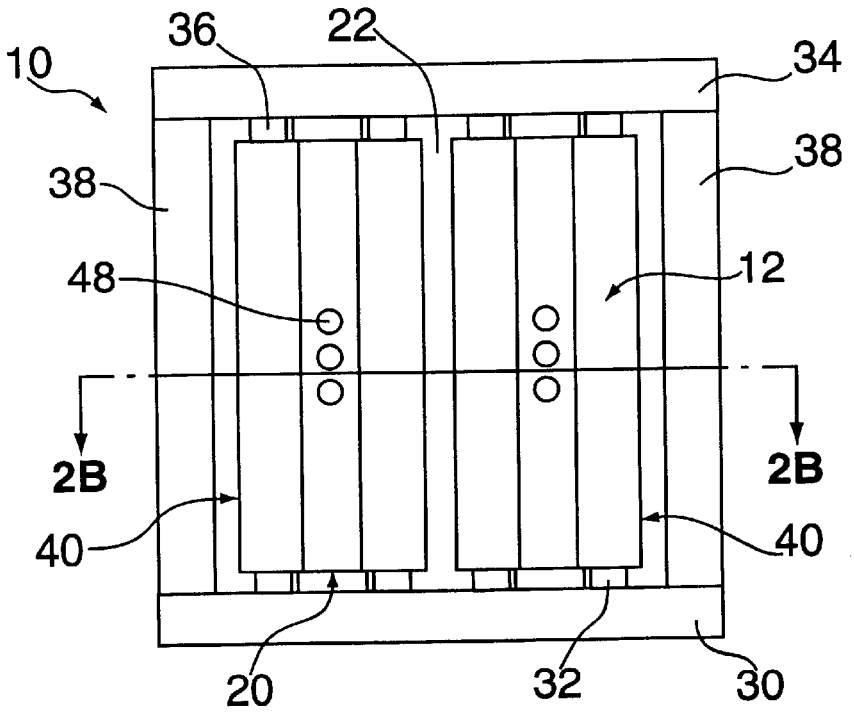
FIG. 2A is a frontal view of a core-type single phase transformer constructed in accordance with the present invention.
Figure 2B:
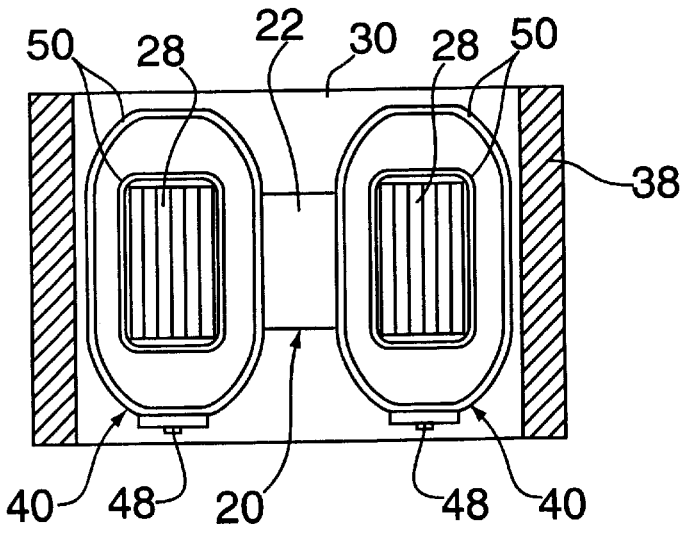
FIG. 2B is a cross-sectional view taken along line B—B of FIG. 2A.
Figure 3A:
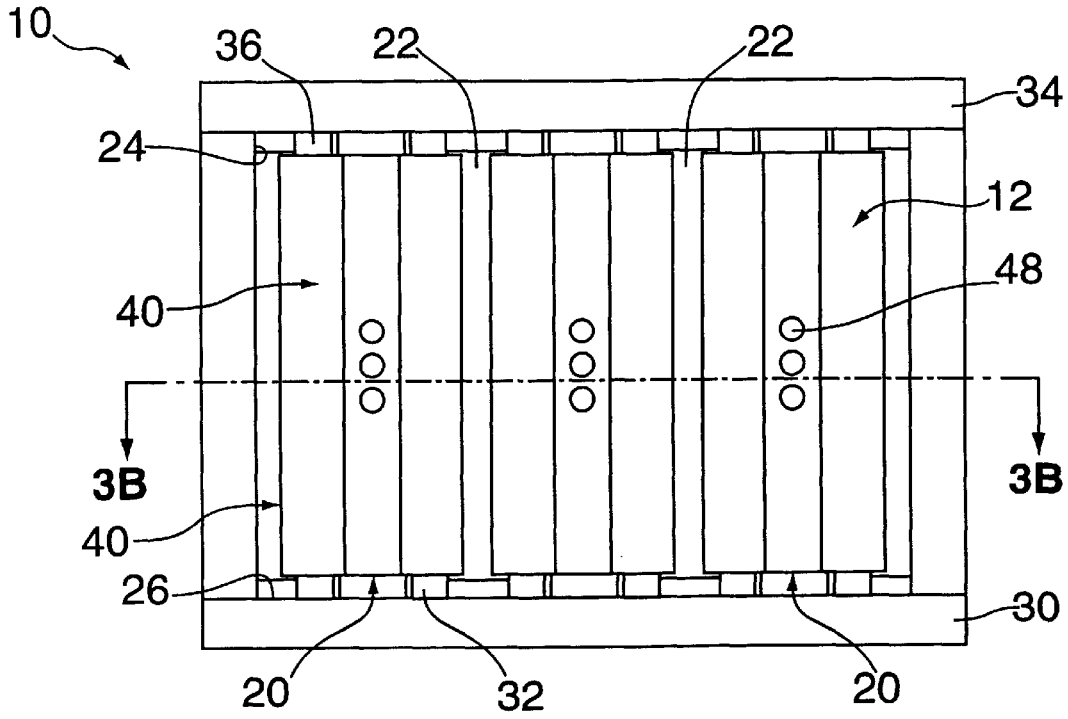
FIG. 3A is a frontal view of a three phase transformer constructed in accordance with the present invention.
Figure 3B:
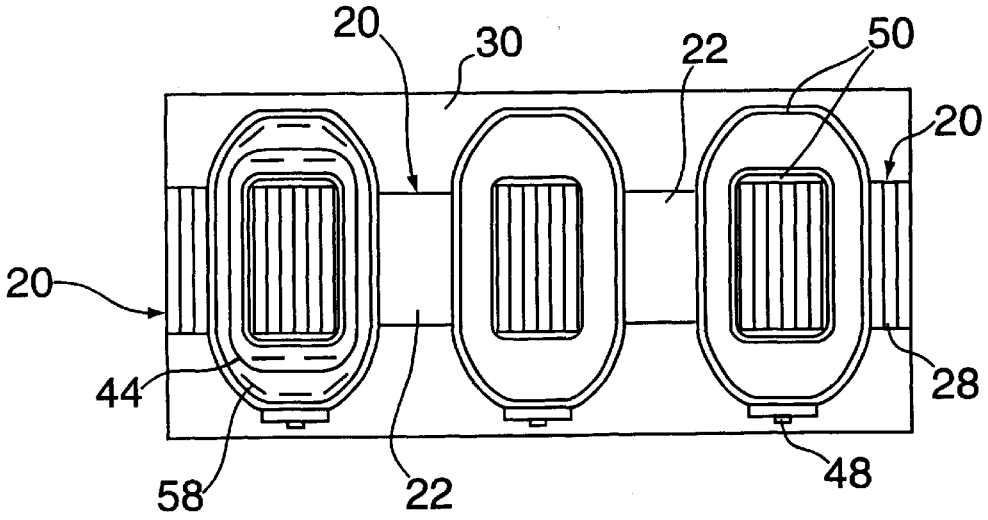
FIG. 3B is a cross-sectional view taken along line B—B of FIG. 3A.

Referring to FIGS. 1A and 2A of the drawings, there is shown two variations of a first embodiment of the present invention: a shell-type single phase power distribution transformer (FIG. 1A); and a core-type single phase power distribution transformer (FIG. 2A). Shell-type single phase transformer comprises a generally rectangular, resin encapsulated coil 40 and two amorphous metal cores 20. Core-type single phase transformer 10 comprises two generally rectangular, resin encapsulated coils 40 and a single amorphous metal core 20. A second embodiment of the invention is depicted in FIG. 3A. In that embodiment shell-type three-phase power distribution transformer 10 comprises three generally rectangular, resin encapsulated coils 40 and four amorphous metal cores 20. While the following detailed description is directed to the shell-type single phase embodiment, it will be understood by those skilled in the art that such description is also applicable to the core-type single phase and to the shell-type three phase transformer embodiments depicted in FIGS. 2A, 2B, 3A and 3B. Furthermore, it will be obvious to persons skilled in the art that the present invention and the detailed description thereof provided below applies to various other dry-type power distribution transformer configurations and designs. Thus, the description provided below for a shell-type single phase transformer is should be interpreted as illustrative and not in a limiting sense.

As used herein, the terms "amorphous metal" and "amorphous metallic alloys" means a metallic alloy that substantially lacks any long range order and is characterized by X-ray diffraction intensity maxima which are qualitatively similar to those observed for liquids or inorganic oxide glasses.

Amorphous metal alloys are well suited for use in forming cores 20, because they have the following combination of properties: (a) low hysteresis loss; (b) low eddy current loss; (c) low coercive force; (d) high magnetic permeability; (e) high saturation value; and (f) minimum change in permeability with temperature. Such alloys are at least about 50% amorphous, as determined by x-ray diffraction. Preferred amorphous metal alloys include those having the formula $M_{60-90}T_{0-5}X_{10-25}$, wherein M is at least one of the elements iron, cobalt and nickel, T is at least one of the transition metal elements, and X is at least one of the metalloid elements of phosphorus, boron and carbon. Up to 80 percent of the carbon, phosphorus and/or boron in X may be replaced by aluminum, antimony, beryllium, germanium, indium, silicon and tin. Used as cores of magnetic devices, such amorphous metal alloys evidence generally superior properties as compared to the conventional polycrystalline metal alloys commonly utilized. Preferably, strips of such amorphous alloys are at least 80% amorphous, more preferably yet, at least 95% amorphous.

The amorphous alloys of cores 20 are preferably formed by cooling a melt at a rate of about $10^{6°}$ C./sec. A variety of well-known techniques are available for fabricating rapidly-quenched continuous amorphous metal strip. When used in magnetic cores for amorphous metal transformers, the strip material of cores 20 typically has the form of a ribbon. This strip material is conveniently prepared by casting molten material directly onto a chill surface or into a quenching medium of some sort. Such processing techniques considerably reduce the cost of fabrication, since no intermediate wire-drawing or ribbon-forming procedures are required.

The amorphous metal alloys of which core 20 is preferably composed evidence high tensile strength, typically about 200,000 to 600,000 psi, depending on the particular composition. This is to be compared with polycrystalline alloys, which are used in the annealed condition and which usually range from about 40,000 to 80,000 psi. A high tensile strength is an important consideration in applications where high centrifugal forces are present, since higher strength alloys prolong the service life of the transformer.

In addition, the amorphous metal alloys used to form core 20 evidence a high electrical resistivity, ranging from about 160 to 180 microhm-cm at 25° C., depending on the particular composition. Typical prior art materials have resistivities of about 45 to 160 microhm-cm. The high resistivity possessed by the amorphous metal alloys defined above is useful in AC applications for minimizing eddy current losses which, in turn, are a factor in reducing core loss.

A further advantage of using amorphous metal alloys to form core 20 is that lower coercive forces are obtained than with prior art compositions of substantially the same metallic content, thereby permitting more iron, which is relatively inexpensive, to be utilized in the core 20, as compared with a greater proportion of nickel, which is more expensive.

Each of the cores 20 is formed by winding successive turns onto a mandrel (not shown), keeping the strip material under tension to effect a tight formation. The number of turns is chosen depending upon the desired size of each core 20. The thickness of the strip material of cores 20 is preferably in the range of 1 to 2 mils. Due to the relatively high tensile strength of the amorphous metal alloy used herein, strip material having a thickness of 1–2 mils can be used without fear of breakage. It will be appreciated that keeping the strip material relatively thin increases the effective resistivity since there are many boundaries per unit of radial length which eddy currents must pass through.

With continued reference to FIGS. 1A and 1B, a shell-type single phase, dry-type power distribution transformer 10 includes a core/coil assembly 12 comprised of two amorphous metal cores 20 and an encapsulated, generally rectangular coil 40. Transformer 10 also includes a bottom frame 30 and top frame 34, having bottom and top coil supports 32, 36, respectively, and within which the core/coil assembly 12 is supportedly mounted. Each core 20 is preferably wound from a plurality of amorphous metal strips or layers 28 having a generally rectangular cross-sectional shape (see FIG. 1B). Each core 20 has two long sides 24 and two short sides 26 that collectively define a generally rectangular core window 22 within which a substantially straight mid-section 52 of the generally rectangular coil 40 of the present invention is located. The aspect ratio, i.e. the relationship between the long and short sides 24, 26 of the core 20, is defined herein as the ratio of the window height (i.e. long side 24) to window width (i.e. short side 26) and is preferably between approximately 3.5 to 1 and 4.5 to 1. This preferred core construction minimizes the number of wound strips or layers 28 of amorphous metal required to construct the core 20 which, in turn, yields lower temperature gradients in the coil 40. Layers of epoxy (not shown) are applied along the long sides 24 to support the height of the core 20. The initial epoxy layer is preferably generally compliant and penetrates between the amorphous metal strips or layers 28 that comprise the core 20. Subsequent epoxy layers are generally more rigid so as to impart the desired strength to the long sides 24 of the core 20. Core 20 is preferably constructed from amorphous metal ribbon having a nominal chemistry $Fe_{80}B_{11}Si_9$, which ribbon is sold by AlliedSignal Inc. under the trade designation METGLAS® alloy SA-1.

The desired shape of the coil 40 of the present invention is generally rectangular. However, other geometric shapes are also considered within the scope of the present invention, provided, however, that such other geometric shapes include a substantially straight mid-section 52 that is sized and shaped to fit within the generally rectangular window 22 of the core 20. For example, the coil 40 may have rounded end sections 54 that are not located within the core window 22, and a generally straight mid-section 52 that passes through and is located within the core window, e.g. an oval with generally straight mid-sections.

Figure 4:
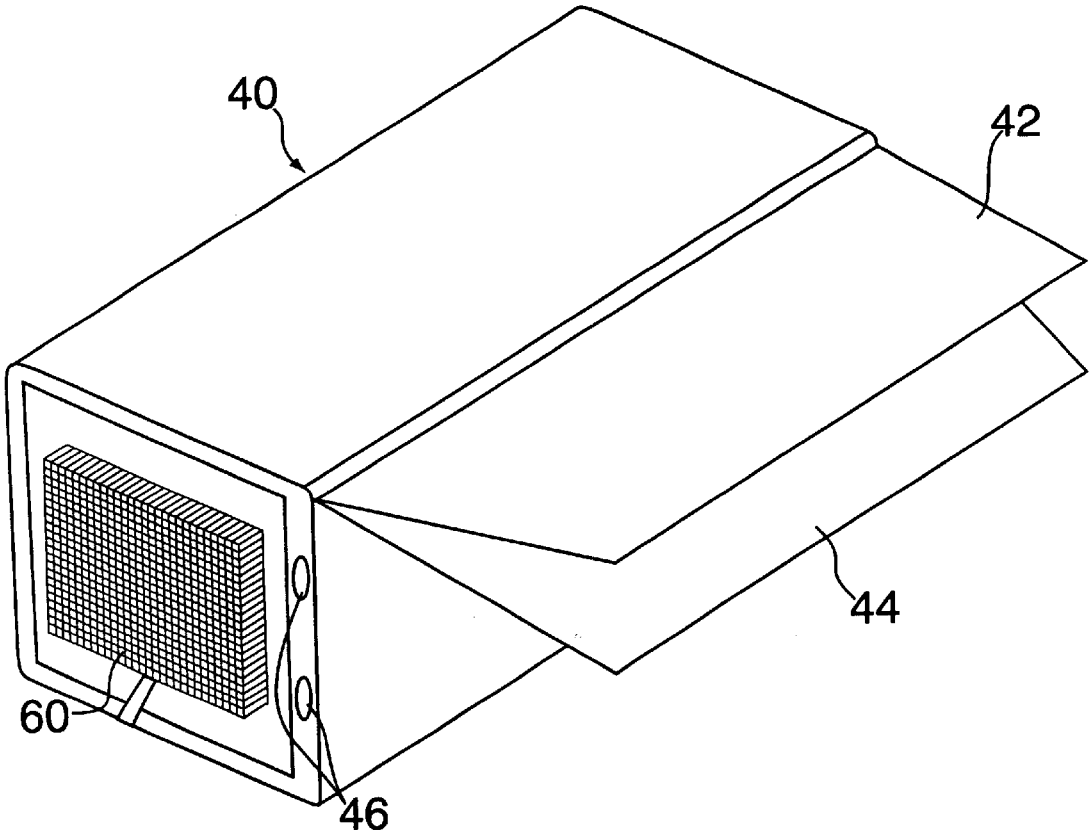
FIG. 4 is a perspective view of a generally rectangular, low voltage coil wound about a rectangular mandrel in accordance with the present invention.
Figure 5:
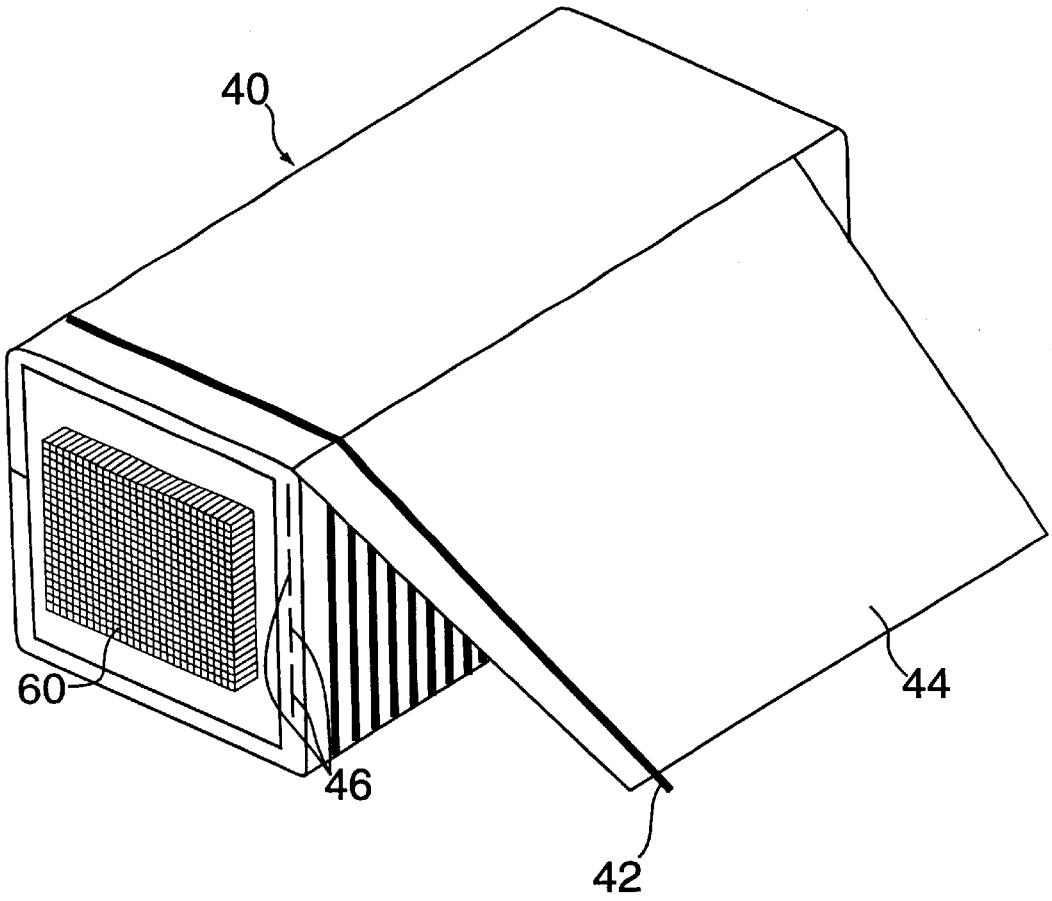
FIG. 5 is a perspective view of a generally rectangular, high voltage coil wound about a rectangular mandrel in accordance with the present invention.

As shown more clearly in FIG. 1B, the generally rectangular coil 40 of the present invention comprises a plurality of coil windings 42 wound along with an insulating material 44 and with selectively placed cooling duct spacers 46 (see FIGS. 4 and 5). The generally rectangular shape of the coil 40 is obtained by winding the coil components (e.g. windings 42 and insulation material 44) about a rectangular winding mandrel 60 (see FIGS. 4 and 5), alternatingly winding coil windings 42 and insulating material 44 in a plurality of concentric layers. In a preferred embodiment, insulating material 44 comprises the inner- and outer-most layers of the wound coil 40 and further provides electrical insulation between adjacently wound coil windings 42. A substantially rectangular coil channel 56 is defined longitudinally through the coil 40 upon removal of the rectangular winding mandrel 60.

Since the coil winding material is typically supplied on a spool, the material may retain a bend radius after the coil 40 is wound, causing the coil 40 to bow or assume a generally oval shape due to the memory of the winding material. This disadvantageously increases the build dimension of the coil, especially in the mid-section 52 which is preferably substantially straight, and may result in coils being too large to fit on the cores 20. It is thus necessary to ensure that coil windings 42 (and the coil 40) retains its generally rectangular shape after it is removed from the winding mandrel 60. One solution provided by the present invention involves using epoxy-dotted kraft paper as the insulating material 44 between the coil windings 42. The epoxy adheres to the coil windings 42 and, upon curing, imparts rigidity to the windings 42 that counteracts the bowing tendency of the winding material. Alternatively, a winding form 62 (see FIGS. 4 and 5) may include metal corners 64 that form corners in the coil windings 42 and the coil 40 is wound on the mandrel 60. A third solution involves shaping the generally rectangular form of the coil 40 as the winding material is wound on the mandrel 60 such as, for example, using a wooden block and nylon hammer. Still another solution involves leaving the coil 40 on the winding mandrel 60 and pressing the long legs of the winding 40 between clamps after the coil 40 has been completely wound and prior to encapsulation. In addition to providing the generally rectangular form to the coil 40, this latter solution serves to further compress the long legs of the coil 40 thereby minimizing build-up among the windings 42 and insulating material 44 in the sections where build-up should be minimized, i.e. the substantially straight mid-sections 52.

To further minimize the size of the finished coil 40, the cooling duct spacers 46 are not placed (and the cooling ducts 58 are not located) in the substantially straight mid-sections 52 of the coil. This provides a distinct advantage over round or toroidal coils that require circumferentially continuous cooling ducts. Thus, a circumferentially discontinuous cooling duct, which is defined by the selective placement of the spacers 46, is provided only in the end sections 54 of the substantially rectangular coil 40.

The insulating material 44 is interspersed between adjacent layers of coil windings 42 to provide electric isolation therebetween and forms the inner- and outer-most layers of the coil 40 (not considering the epoxy encapsulation described below). In a preferred embodiment, the insulating material 44 comprises a sheet or sheets of aramid paper such as Dupont's Nomex® brand. It will be obvious to those skilled in the art that various other insulating materials may be provided without departing from the spirit or intent of the present invention.

The inner-most and outer-most sheets of insulating material 44 are preferably sized so as to extend approximately 12 mm beyond the longitudinal ends of the coil 40. In addition, the insulating material 44 located on each side of the cooling duct spacers 46 also extends approximately 12 mm past the ends of the coil 40. These sheets of extended insulation material 44 are sealed with a thick epoxy such as, for example, that made by Magnolia Co., part number 3126, A/B. The epoxied extended sheets of insulation material 44 then serve to contain any uncured epoxy during the encapsulation process (described in more detail below) of the coil 40.

Cooling for dry-type power distribution transformers may be either convective or forced-air. Cooling ducts 58 are thus necessary between the coil windings to permit the passage of air therethrough. The cooling duct spacers 46 may be inserted between coil windings 42 as the coil 40 is wound and are removed after the coil 40 has been encapsulated (as described in further detail below). Since it is desirable to control the wound dimensions of the coil 40 to ensure that it will fit within the core window 22 of the core 20, the cooling duct spacers 46 are advantageously inserted only in those sections of the coil 40 that will not be located within the core window 22 (i.e. at the longitudinally distal ends of the coil 40, as clearly shown in FIG. 1B) in the assembled transformer 10.

Thus the dimension of the coil 40 is controlled in the section that will be located within the core window 22 thereby providing smaller (i.e. narrower) coils 40 that, in turn, produce smaller power distribution transformers. The generally rectangular shape of the coil of the present invention permits the use of cooling ducts 58 that are non-continuous about the circumference of the rectangular coil. The desirability of selectively locating the cooling ducts 58 and of providing circumferentially non-continuous cooling ducts 58 is clear considering the fact that the cooling ducts 58 increase the size of the coil—which is undesirable especially in the substantially straight mid-section 52 of the coil 40. The generally rectangular shape of the coil 40 of the present invention provides four clearly delineated sides (which round or toroidal coils do not) which permit selective location of the cooling ducts 58 in the end sections 54 of the coil 40.

For low voltage coils, such as those typically used as the secondary winding of a power distribution transformer, the coil winding 42 comprises a sheet or sheets of aluminum or copper (see FIG. 4). For high voltage coils, such as those typically used as the primary winding of a power distribution transformer, the coil winding 42 comprises a cross-sectionally rectangular or circular copper wire (see FIG. 5). For both low and high voltage coils, the coil 40 is wound on a rectangular mandrel 60, preferably in conjunction with a winding form 62 having metal corners 64 having a predefined angular configuration. The substantially rectangular coil 40 of the present invention may comprise only a low voltage or a high voltage coil or, alternatively, it may comprise both low and high voltage coils. The wound coil 40 is completely contained in and encapsulated by an epoxy resin layer 50, as described in more detail below.

Referring to FIGS. 4 and 5, there is shown a generally rectangular coil 40 configured in accordance with the present invention for low voltage and high voltage applications, respectively. The low voltage coil 40 shown in FIG. 4 is formed by winding a coil winding 42 such as, for example, a sheet of copper or aluminum, about a generally rectangular winding mandrel 60. To electrically isolate adjacent layers of windings 42, an insulating material 44 is interspersed therebetween. The insulating material 44 comprises the inner- and outer-most layers of the wound coil 40. Cooling ducts 58 are provided in the wound coil 40 by inserting cooling duct spacers 46 between the coil windings 42 as the coil 40 is wound. The spacers 46 are removed after the coil 40 is encapsulated and the cooling ducts 58 are thus defined by the cavity created by the removed spacer 46. The high voltage coil 40 depicted in FIG. 5 is formed in a manner similar to that of the low voltage coil 40 of FIG. 4, except that the coil winding 42 comprises a rectangular or round copper wire that is spiral or disk wound about the rectangular mandrel 60.

Figure 6:
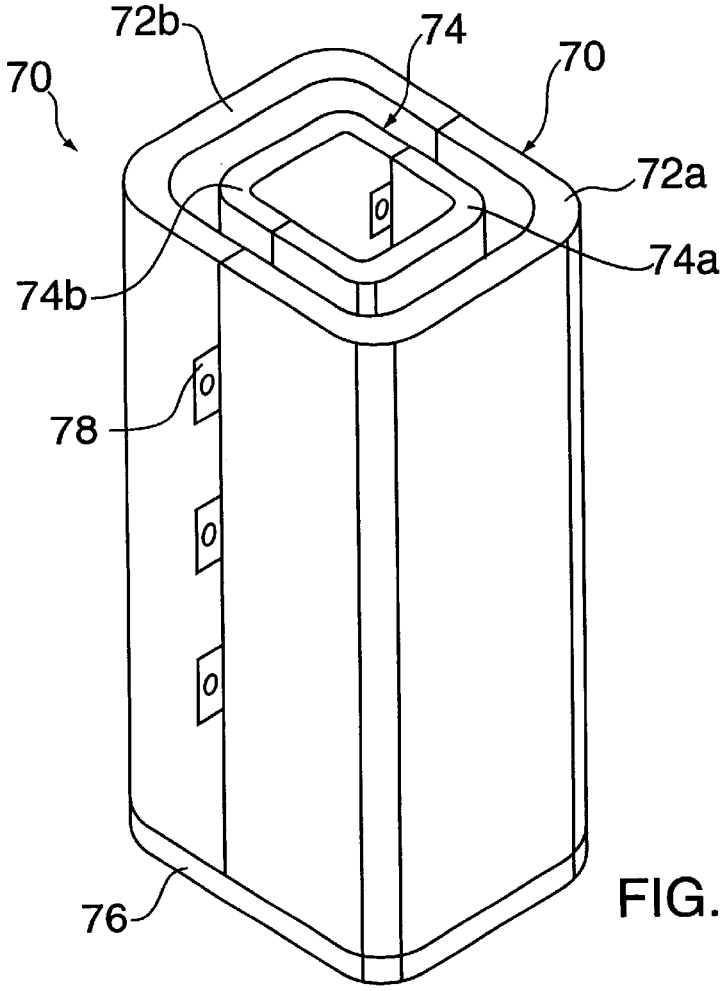
FIG. 6 is a perspective view of an epoxy containment vessel configured for encapsulating a generally rectangular coil in accordance with the present invention.

The coil 40 of the present invention is encapsulated in an epoxy resin layer 50 using a containment vessel 70 as depicted in FIG. 6. The vessel 70 comprises a vessel shell 72 having first and second halves 72*a*, 72*b*, a vessel core 74, and a vessel bottom 76. The vessel core 74 may also comprise first and second halves 74*a*, 74*b*, or, alternatively, the vessel core 74 may comprise the rectangular winding mandrel 60 upon which the generally rectangular coil 40 of the present invention is wound and formed. Brackets 78 provided on the first and second vessel halves 72*a*, 72*b* may be used to hold the two halves together during the encapsulation process.

Figure 7:
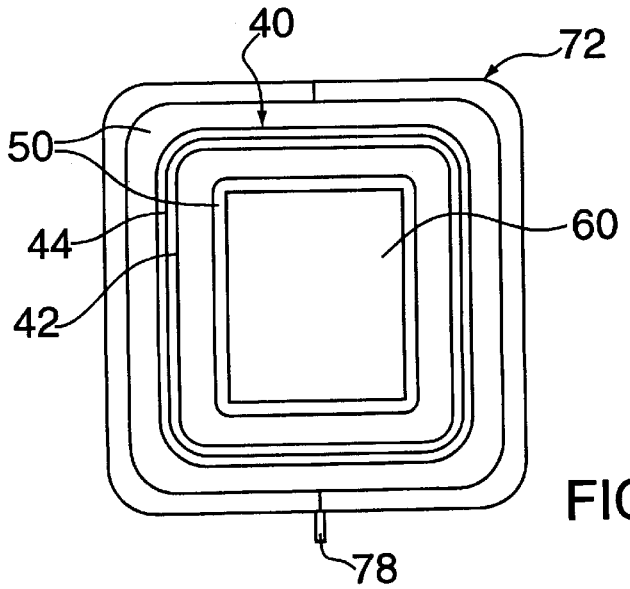
FIG. 7 is a top view of the epoxy containment vessel of FIG. 6 with a generally rectangular coil contained therein.
Figure 8:
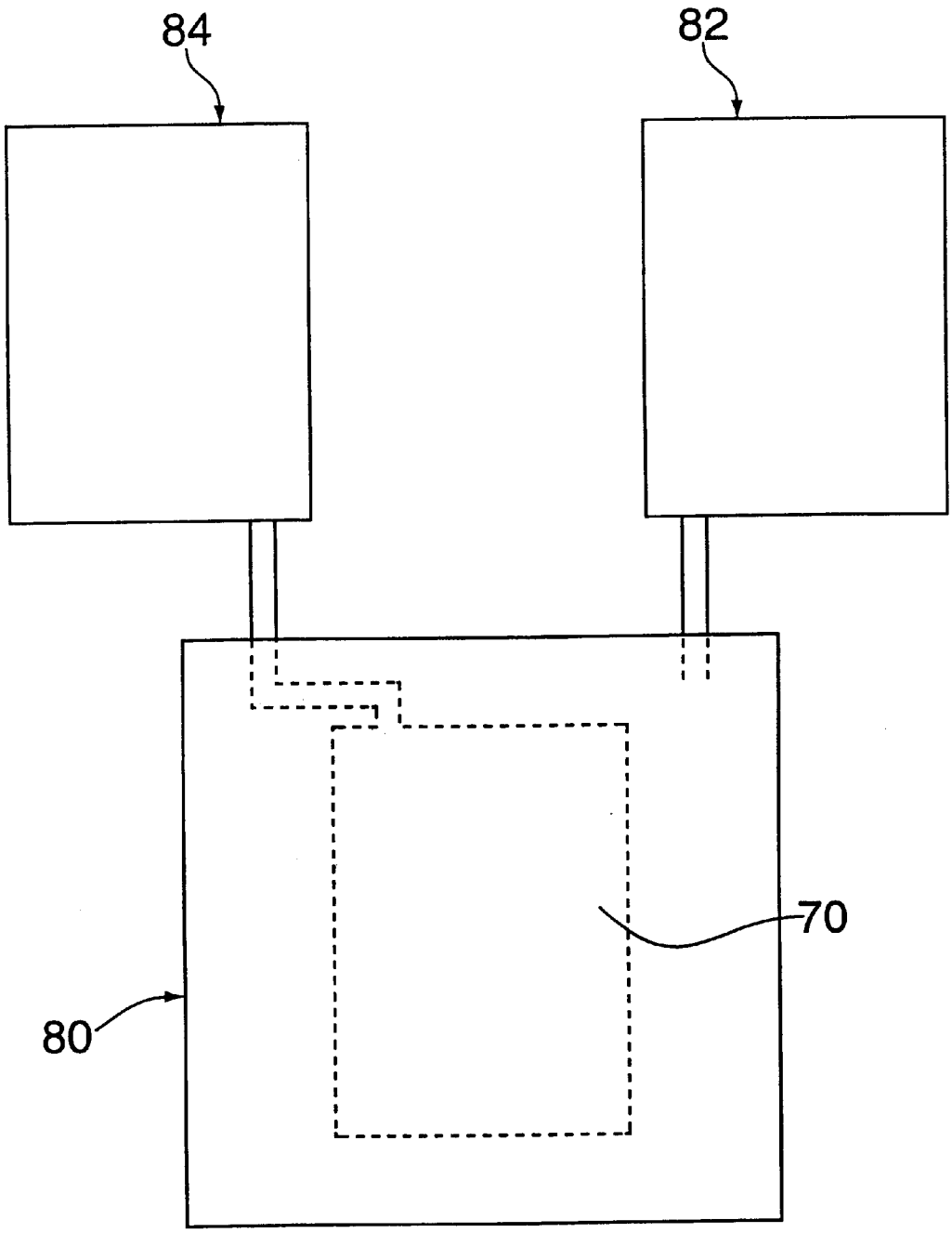
FIG. 8 is a block diagram of an encapsulation system for encapsulating a coil constructed in accordance with the present invention.

The encapsulation process will now be discussed in detail and with reference to FIGS. 6, 7 and 8. The wound coil 40 is placed in the containment vessel 70 which preferably extends beyond the top of the coil 40 by approximately 100 mm to allow for any shrinkage in the epoxy after curing. The vessel 70 and coil 40 are then loaded into a vacuum chamber 80 that is connected to a vacuum source 82 and an epoxy source 84. The chamber 80 is then evacuated by the vacuum source 82 to approximately 150 torr. A low viscosity epoxy such as a bisphenol A epoxy resin of the type sold by Magnolia Co. as part number 111-047, A/B, is introduced into and completely fills the containment vessel 70. When the vessel 70 is filled to the top with epoxy, the vacuum chamber 80 is further evacuated to approximately 20 torr. Additional epoxy is fed into the containment vessel 70 if the epoxy level therein drops during the above-described pressure changes within the chamber 80. Once the containment vessel 70 is completely filled with epoxy and the epoxy level is stabilized within the vessel 70, the epoxy is cured to produce an epoxy resin layer 50 the completely surrounds and encapsulates the coil 40. After the epoxy has cured, the coil 40 is removed from the containment vessel 70 and the cooling duct spacers 46 are removed from the coil 40.

The generally rectangular, resin encapsulated coil 40 may now be used together with a wound amorphous metal core 20 having a generally rectangular cross-section and a generally rectangular core window 22. The substantially straight section 52 of the coil 40 is located within the core window 22 and substantially matches the size and shape of the window 22.

Thus, the present invention provides a dry-type power distribution transformer having a wound amorphous metal core having a generally rectangular cross-sectional shape and a generally rectangular resin encapsulated coil. The encapsulation protects the coil against harsh environmental conditions, protects the insulation system of the coil, improves the coil strength under short-circuit conditions, and improves the coil's cooling characteristics by providing a smooth, uniform surface about the coil's exterior over which air (either forced or convective) may smoothly and easily pass. In addition, by matching the shape of the coil to that of the core's cross-section, the present invention provides a dry-type amorphous metal power distribution transformer that is less expensive to manufacture, is less resistive and thus less lossy (less coil material is needed to wind the coil), and that is more compact than prior art transformers having generally round or circular coils. The present invention thus provides a durable and robust dry-type power distribution transformer that uses the transformer materials in a more economical manner thereby reducing manufacturing costs and overall transformer size.

Having thus described the invention in rather full detail, it will be understood that such detail need not be strictly adhered to, but that various changes and modifications may suggest themselves to one skilled in the art, all falling within the scope of the invention, as defined by the subjoined claims.

What is claimed is:

1. A dry-type power distribution transformer comprising:

a resin encapsulated coil having a substantially straight section; and an amorphous metal core having a core window defined therein;

said coil and said core being sized and shaped such that the shape of said substantially straight section of said coil substantially conforms to the shape of said core window, said substantially straight section of said coil being located within said core window when said coil and said core are assembled to form said power distribution transformer, and said coil having a plurality of cooling ducts circumferentially non-continuous about said coil and being located in a part of said coil that does not comprise said substantially straight section.

2. A dry-type power distribution transformer as recited in claim 1, wherein said coil further comprises:

a plurality of concentric layers comprising a conductive coil winding and an insulating material providing electric isolation between adjacent concentric layers of said coil; and a resin layer that encapsulates said coil.

3. A dry-type power distribution transformer as recited in claim 2, wherein said plurality of cooling ducts are defined between adjacent ones of said plurality of concentric layers.

4. A dry-type power distribution transformer as recited in claim 2, wherein said coil winding is constructed of a material selected from the group of materials consisting of aluminum and copper.

5. A dry-type power distribution transformer as recited in claim 2, wherein said resin layer comprises a low viscosity epoxy resin.

6. A dry-type power distribution transformer as recited in claim 5, wherein said low viscosity resin is a bisphenol A epoxy resin.

7. The dry type transformer of claim 2 wherein the plurality of concentric layers are generally rectangular.

8. A dry-type power distribution transformer as recited in claim 1, wherein said core is made from an amorphous metal alloy having the formula $$M_{60\text{-}90}T_{0\text{-}15}X_{10\text{-}25},$$

wherein M is at least one of the elements iron, cobalt and nickel, T is at least one of the transition metal elements, and X is at least one of the metalloid elements phosphorus, boron and carbon, and wherein up to 80 percent of the carbon, phosphorus and boron content is optionally substituted by aluminum, antimony, beryllium, germanium, indium, silicon and tin.

9. A dry-type power distribution transformer as recited by claim 8, wherein said core is made from an amorphous metal alloy having the formula $Fe_{80}B_{11}Si_9$.

10. A dry-type power distribution transformer as recited in claim 1, wherein said core window defines an aspect ratio of between approximately 3.5 to 1 and 4.5 to 1.

11. A dry-type power distribution transformer as recited in claim 1, wherein said coil is a low voltage coil.

12. A dry-type power distribution transformer as recited in claim 1, wherein said coil is a high voltage coil.

13. A dry-type power distribution transformer as recited in claim 1, wherein said coil comprises a low voltage coil and a high voltage coil.

14. A dry-type power distribution transformer as recited in claim 1, wherein said core is a wound core.

15. A dry-type power distribution transformer as recited in claim 1, wherein said core window defines an aspect ratio of at least 3.5 to 1.

16. The dry type transformer as recited in claim 1 wherein said resin encapsulated coil has a generally rectangular shape and said amorphous metal core has a generally rectangular window defined therein.

17. A dry-type power distribution transformer comprising:

a resin encapsulated coil having a substantially straight section formed by alternately winding a conductive material and an insulating material on a rectangular winding form to form a plurality of generally rectangular concentric layers of insulating and conductive material and thereafter forming an encapsulating resin layer that encapsulates said coil; and a amorphous metal core having a core window defined therein;

said coil and said core being sized and shaped such that the shape of said substantially straight section of said coil substantially conforms to the shape of said core window, said substantially straight section of said coil being located within said core window when said coil and said core are assembled to form said power distribution transformer, and said coil having a plurality of cooling ducts circumferentially non-continuous about said coil and being located in a part of said coil that does not comprise said substantially straight section.

18. A dry-type power distribution transformer as recited in claim 17, wherein said conductive material is selected from a group of materials consisting of aluminum and copper.

19. A dry-type power distribution transformer as recited in claim 17, wherein said core is a wound core.

20. A dry-type power distribution transformer as recited in claim 17, wherein said core is made from an amorphous metal alloy having the formula $$M_{60\text{-}90}T_{0\text{-}15}X_{10\text{-}25},$$

wherein M is at least one of the elements iron, cobalt and nickel, T is at least one of the transition metal elements, and X is at least one of the metalloid elements phosphorus, boron and carbon, and wherein up to 80 percent of the carbon, phosphorus and boron content is optionally substituted by aluminum, antimony, beryllium, germanium, indium, silicon and tin.

21. A dry-type power distribution transformer as recited by claim 20, wherein said core is made from an amorphous metal alloy having the formula $Fe_{80}B_{11}Si_9$.

22. A dry-type power distribution transformer as recited in claim 17, wherein said core window defines an aspect ratio of between 3.5 to 1 and 4.5 to 1.

23. A dry-type power distribution transformer as recited in claim 17, wherein said coil is a low voltage coil.

24. A dry-type power distribution transformer as recited in claim 17, wherein said coil is a high voltage coil.

25. A dry-type power distribution transformer as recited in claim 17, wherein said coil comprises a low voltage coil and a high voltage coil.

26. A dry-type power distribution transformer as recited in claim 17, wherein said plurality of cooling ducts are defined between adjacent ones of said plurality of concentric layers.

27. A dry-type power distribution transformer as recited in claim 17, wherein said resin layer comprises a low viscosity epoxy resin.

28. A dry-type power distribution transformer as recited in claim 27, wherein said low viscosity resin is a bisphenol A epoxy resin.

29. A dry-type power distribution transformer as recited in claim 17, wherein said core window defines an aspect ratio of at least 3.5 to 1.

30. The dry type power distribution transformer of claim 17 wherein the resin encapsulated coil has a generally rectangular shape and said amorphous metal core has a generally rectangular window defined therein.

31. A resin encapsulated coil having a substantially straight section, said coil comprising:

a plurality of generally rectangular concentric layers comprising a conductive coil winding and an insulating material providing electric isolation between adjacent concentric layers of said coil;

a plurality of cooling ducts circumferentially non-continuous about said coil and being located in a part of said coil that does not comprise said substantially straight section; and a resin layer that encapsulates said coil.

32. A resin encapsulated coil as recited in claim 31, wherein said coil is a high voltage coil.

33. A resin encapsulated coil as recited in claim 31, wherein said coil comprises a low voltage coil and a high voltage coil.

34. A resin encapsulated coil as recited in claim 31, wherein said coil further comprises a plurality of cooling ducts defined between adjacent ones of said plurality of concentric layers, said cooling ducts being circumferentially non-continuous about said generally rectangular coil and being located in a part of said coil that does not comprise said substantially straight section.

35. A resin encapsulated coil as recited in claim 31, wherein said coil winding is selected from a group of materials consisting of aluminum and copper.

36. A resin encapsulated coil as recited in claim 31, wherein said resin layer comprises a low viscosity epoxy resin.

37. A resin encapsulated coil as recited in claim 35, wherein said low viscosity resin is a bisphenol A epoxy resin.

38. A resin encapsulated coil as recited in claim 31, wherein said coil is a low voltage coil.

39. The resin encapsulated coil of claim 31 having a generally rectangular shape and said concentric layers having generally rectangular shape.

40. A method of making a dry-type power distribution transformer, comprising the steps of:

(a) forming a coil having a substantially straight section and having a plurality of cooling ducts circumferentially non-continuous about said coil and being located in a part of said coil that does not comprise said substantially straight section;

(b) encapsulating said coil in an epoxy resin;

(c) forming a core from amorphous metal, said core having a substantially rectangular window defined therein; and (d) assembling a dry-type power distribution transformer from said encapsulated coil and said amorphous metal core such that said substantially straight section of said coil is located within said core window and wherein the shape of said substantially straight section of said coil substantially conforms to the shape of said core window.

41. A method of making a dry-type power distribution transformer as recited in claim 40, wherein said step (a) further comprises:

(e) alternatingly winding a conductive material and an insulating material on a rectangular winding form to form a plurality of concentric layers of insulating and conductive material, said insulating material providing electric isolation between adjacent concentric layers of said conductive material.

42. The method of claim 40 wherein the coil is formed to have a generally rectangular shape the core is formed to have a generally rectangular window.

43. A method of making a dry-type power distribution transformer as recited in claim 40, wherein said step (b) further comprises:

(f) placing said coil in a containment vessel;

(g) pacing said containment vessel in a vacuum chamber;

(h) vacating said vacuum chamber to a predetermined pressure;

(i) filling said containment vessel with an epoxy resin; and (j) curing said epoxy resin so as to form an epoxy resin layer that encapsulates said coil.

44. A method of making a dry-type power distribution transformer as recited in claim 43, wherein said predetermined pressure of said step (h) is approximately 150 torr.

45. A process for the manufacture of a high voltage dry-type power distribution transformer which process comprises the steps of:

(a) forming a coil having at least one substantially straight section by alternately winding a conductive material and an insulating material on a winding form to form a plurality of concentric layers of insulating material and conductive material;

(b) encapsulating said coil under vacuum conditions with an epoxy resin composition;

(c) curing said epoxy resin composition to form an encapsulation layer bout said coil;

(d) forming a core of an amorphous metal having a substantially rectangular window defined therein;

(e) assembling the core and the encapsulated coil to such that the said substantially straight section of the coil is located within the said substantially rectangular window.

* * * * *